US008418615B2

(12) United States Patent
Bauer et al.

(10) Patent No.: US 8,418,615 B2
(45) Date of Patent: Apr. 16, 2013

(54) METHOD FOR INDIVIDUALISING SECURITY DOCUMENTS AND CORRESPONDING SECURITY DOCUMENT

(75) Inventors: Michael Bauer, Gernlinden (DE); Werner Bochmann, Ismaning (DE)

(73) Assignee: Giesecke & Devrient GmbH, Munich (DE)

( * ) Notice: Subject to any disclaimer, the term of this patent is extended or adjusted under 35 U.S.C. 154(b) by 1117 days.

(21) Appl. No.: 10/490,478

(22) PCT Filed: Sep. 19, 2002

(86) PCT No.: PCT/EP02/10537

§ 371 (c)(1),
(2), (4) Date: Aug. 20, 2004

(87) PCT Pub. No.: WO03/029019

PCT Pub. Date: Apr. 10, 2003

(65) Prior Publication Data

US 2004/0262909 A1 Dec. 30, 2004

(30) Foreign Application Priority Data

Sep. 24, 2001 (DE) ..... 101 46 912

(51) Int. Cl.
*B41F 31/00* (2006.01)
*B41F 33/00* (2006.01)

(52) U.S. Cl.
USPC ..... 101/491; 101/483

(58) Field of Classification Search ..... 428/199; 705/50; 101/150, 151, 153, 170, 422, 483, 101/491
See application file for complete search history.

(56) References Cited

U.S. PATENT DOCUMENTS

| | | | | |
|---|---|---|---|---|
| 3,599,153 | A * | 8/1971 | Lewis et al. | 235/449 |
| 3,811,915 | A * | 5/1974 | Burrell et al. | 428/143 |
| 3,980,018 | A | 9/1976 | Ichikawa | |
| 4,536,013 | A | 8/1985 | Haghiri-Therani et al. | |
| 4,588,212 | A * | 5/1986 | Castagnoli | 283/91 |

(Continued)

FOREIGN PATENT DOCUMENTS

| | | |
|---|---|---|
| JP | 54-111554 A | 8/1979 |
| JP | 55-25053 A | 2/1980 |

(Continued)

OTHER PUBLICATIONS

Dictionary.com definition of "gravure", Dec. 20, 2007.*

(Continued)

*Primary Examiner* — Judy Nguyen
*Assistant Examiner* — Leo T Hinze
(74) *Attorney, Agent, or Firm* — Rothwell, Figg, Ernst & Manbeck, P.C.

(57) ABSTRACT

A method for individualizing security documents provides that high security quality, application-neutral printed image 1 identical for a group of security documents is overprinted with second printed image 2 individualizing the security document, whereby the printing ink of second printed image 2 is repelled by the printing ink of first printed image 1. The printing ink of the second printed image is therefore deposited only in the areas of the first printed image where no printing ink of the first printed image is present. Preferably, the first printed image is produced by intaglio printing and the second printed image by means of liquid printing ink, in particular by the ink jet method.

13 Claims, 1 Drawing Sheet

U.S. PATENT DOCUMENTS

| | | | | |
|---|---|---|---|---|
| 5,665,457 | A * | 9/1997 | Sato et al. | 428/195.1 |
| 5,787,186 | A * | 7/1998 | Schroeder | 382/115 |
| 6,176,522 | B1 | 1/2001 | Jackson | |
| 6,369,843 | B1 * | 4/2002 | Springett et al. | 347/173 |
| 6,505,179 | B1 * | 1/2003 | Kara | 705/50 |
| 6,546,872 | B1 * | 4/2003 | Huffer et al. | 101/491 |
| 6,701,605 | B2 * | 3/2004 | Huffer et al. | 29/601 |
| 6,928,925 | B1 * | 8/2005 | Mayer et al. | 101/150 |
| 7,131,380 | B2 * | 11/2006 | Huffer | 101/491 |
| 7,213,512 | B2 * | 5/2007 | Braun et al. | 101/153 |
| 7,311,043 | B2 * | 12/2007 | Mayer et al. | 101/150 |
| 7,357,077 | B2 * | 4/2008 | Adamczyk et al. | 101/170 |

FOREIGN PATENT DOCUMENTS

| | | | |
|---|---|---|---|
| JP | 57-14661 | A | 1/1982 |
| JP | 58-188687 | A | 11/1983 |
| JP | 3-53971 | A | 3/1991 |
| JP | 3-96385 | A | 4/1991 |
| JP | 4-12850 | A | 1/1992 |
| JP | 5-115833 | A | 5/1993 |
| JP | 05-338388 | | 12/1993 |
| JP | 6-138315 | A | 5/1994 |
| JP | 90-94938 | | 4/1997 |
| JP | 2000025136 | | 1/2000 |
| JP | 2001071446 | | 3/2001 |
| WO | WO 01/49505 | A1 | 7/2001 |

OTHER PUBLICATIONS

Dictionary.com definition of "intaglio printing", Dec. 21, 2007.*

Meyers, H., "130 Bildnerische Techniken", Otto Maier Verlag, 3 Aufl., 1958, pp. 76-77.

* cited by examiner

METHOD FOR INDIVIDUALISING SECURITY DOCUMENTS AND CORRESPONDING SECURITY DOCUMENT

CROSS-REFERENCE TO RELATED APPLICATION

This application is a §371 of PCT Application Serial No. PCT/EP02/10537, filed Sep. 19, 2002.

FIELD OF THE INVENTION

This invention relates to a method for individualizing security documents and to a corresponding security document and a group of individualized security documents wherein a first printed image, which can be identical for a group of documents, is overprinted at least partly with a second printed image, which can be different for subgroups of said group or for each document of said group.

DESCRIPTION OF BACKGROUND ART

DE 29 33 436 C2 discloses for example a multilayer ID card containing an application-neutral, high security quality printed image, for example a guilloche pattern produced by steel gravure printing, on a paper substrate onto which user-related data, for example a photograph or other individualizing data, are copied directly by an electrophotographic method to connect said data with the paper substrate undetachably and untamperably. Said substrate is then laminated with transparent cover foils to form the ID card. The method can also be used in connection with other documents, papers of value, shares, etc., requiring protection.

The only possibility of forgery is unauthorized personalization of original blanks printed with the application-neutral printed image, but this can be prevented by accordingly safe storage of said blanks. Total forgery of the high security quality printed paper blanks is also impossible. The described method is therefore expedient whenever the forgery-proofness and tamper-proofness of document and data must be ensured, on the one hand, but the individual data are to be applied with relatively simple means, on the other hand.

The same interest in tamper- and forgery-proofness as well as simple individualizability exists for application of individual data to passport pages and labels to be stuck to passport pages, so-called visa stickers, and in addition in connection with documents accompanying goods, customs documents, authenticity certificates in the form of stickers or tags or labels, vouchers, admission tickets, checks, shares and deeds.

Data pages of passports and visa stickers are frequently provided with nonvariable prints produced by intaglio printing. For example, the header of such documents specifies the national emblem and the name of a country which are not overprinted since they might otherwise be at least partly concealed by the overprint. Individual and/or user-related data are therefore printed at other places using a laser printer, daisy-wheel or ink jet printer for example.

SUMMARY OF THE INVENTION

The problem of the present invention is to combine a high security quality printed image common to a group of documents with an easily produced individualizing print in especially suitable forgery-proof fashion.

This problem is solved by an individualization method and by a corresponding security document.

Accordingly, a printed image produced by intaglio printing in conventional fashion, which is identical for a group of security documents and can be for example a guilloche pattern, is overprinted by an individualizing printed image using a printing ink that is flowable at least at the time of printing. This has the consequence that said printing ink is repelled by the intaglio printing ink and deposited at places where no intaglio printing ink is located. The printed image produced by intaglio printing thus remains completely visible and forms fine lines within the individualizing printed image. The fine lines do not essentially impair the information content of the individualizing printed image, even when the individualizing printed image is a rendition by printing technology of a photographic portrait, for example of the document owner, referred to in the following as the photograph. The individualizing printed image is merely, when viewed under the magnifying glass, interrupted by the structures produced by intaglio printing, the details becoming apparent in particular only when viewed through a magnifying glass. Such superimposed structures are virtually non-tamperable.

An especially suitable method for producing the individualizing printed image has proved to be an ink jet printing method with commercial black or color cartridges. This method is inexpensive and uses printing ink that is repelled by customary steel gravure printing inks. A likewise suitable method is a digital printing process developed by the company, Indigo B.V./Netherlands (also referred to here as the Indigo printing process). In this method, electrically charged color particles dispersed in a liquid are applied to a substrate by means of electric fields. The Indigo process yields similarly good printing quality to offset printing, but permits continuous change of the printed motifs. Since the printed motifs can also be characters rendering individual data, this digital printing process is particularly suitable for individualizing documents.

But the inventive method is fundamentally applicable to all security documents having an application-neutral printed image comprising mutually contrasting light and dark areas (i.e. in particular an intaglio image), whereby either the light or the dark areas of the printed image have a repellent effect on the printing ink of an individualizing printed image printed thereover, so that the printing ink of the individualizing printed image is deposited substantially only in the accordingly other areas. Obviously, when this inventive principle is realized by printing technology, small residues of the printing ink of the individualizing print can remain for example in small pores or fine grooves of the inking of the first printed image without appreciably influencing the general visual impression.

Preferably, the areas where printing ink is deposited are unprinted substrate areas, since unprinted substrate areas are especially suitable for receiving printing ink, in particular in the case of a paper substrate, for example a normal security paper.

But it is equally possible that the substrate is a material repelling the printing ink of the individualizing printed image, for example printing ink on a plastic substrate, but that the same printing ink does in fact adhere to the areas of the application-neutral image printed with adhesive material. If the application-neutral image is printed with dark printing ink on a light substrate, this causes the application-neutral image to appear like a negative in its overprinted part.

The individualizing printed image can contain one or more pieces of individualizing information, for example a continuous number (serial number), a photograph and/or personal data of the document owner in plaintext and/or the same or other data in the form of a machine-readable bar code.

BRIEF DESCRIPTION OF THE DRAWINGS

In the following, the invention will be explained by way of example with reference to the accompanying drawings, in which.

DETAILED DESCRIPTION OF THE INVENTION

Figure 1A:
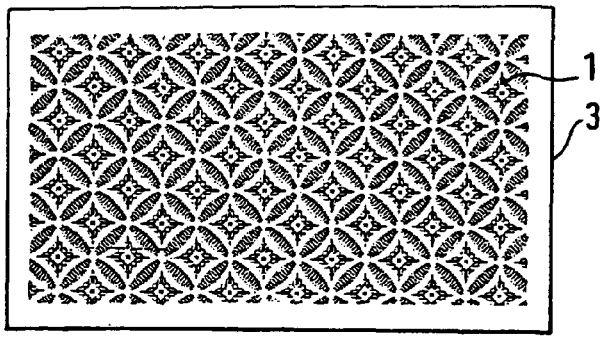
FIG. 1*a* shows a first high security quality printed image identical for a group of security documents, on a substrate.

FIG. 1*a* shows schematically a document comprising substrate 3 with first print 1. Print 1 is a high security quality printed image which is identical for a large number of security documents, for example identical for the pages of a passport document of a certain nation or for example for all visa stickers used for a certain nation.

The embodiment of FIG. 1*a* involves a uniform basic pattern produced by intaglio printing, typically by steel gravure in the case of industrially applied methods. But it can likewise be an informative printed image, such as the portrait of a well-known personality, as is known from bank notes.

Intaglio printing is frequently used for protection from forgery in the production of high-quality printed products since printing plate production is very elaborate and expensive and this method can produce a very characteristic printed image with tactile portions, which cannot be imitated with other printing processes. Depressions are engraved in the printing plate as engraved areas, typically in the form of lines. For the printing operation, the engraved areas of the plate are filled with ink. Surplus ink is removed from the plate using a wiping cylinder or doctor blade, so that only the engraved lines remain ink-filled. This wiping process thus removes all ink constituents on the plate surface. Using a counterpressure cylinder with an elastic surface, the substrate to be printed, normally paper, is then pressed onto the plate at high pressure. The document is thereby pressed into the engraved areas of the plate filled with pasty ink, thus coming in contact with the printing ink. When the data carrier is detached it extracts printing ink from the depressions of the engraved lines. The thus achieved printed image has printed areas that vary in ink layer thickness depending on the depth of engraving. If translucent printing inks are used in intaglio printing, a light color tone is obtained when a light, in particular white, data carrier is printed with small ink layer thicknesses, and stronger, darker color tones when printing is done with thick ink layer thicknesses. In comparison with other common printing processes, intaglio printing can produce printed images with relatively great and different ink layer thicknesses. From a security point of view this offers the advantage that the resulting printed images are manually tangible if accordingly deep engravings are used. If especially fine engravings are used, extremely fine and very sharp printed lines can also be realized.

Figure 1B:
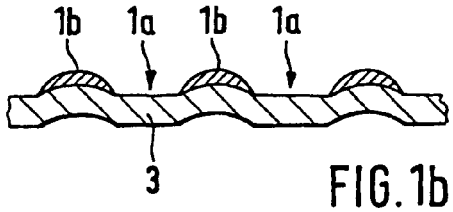
FIG. 1*b* shows a detail of the substrate from FIG. 1*a* in cross section.

FIG. 1*b* shows a detail of the document from FIG. 1*a* in cross section. The substrate is a typical security paper, optionally with watermarks. One can see that printed image 1 is composed of unprinted areas 1*a* and areas 1*b* printed with intaglio printing ink. For printed image 1 to be able to show its optical effect, the color of printed areas 1*b* contrasts with the color of unprinted areas 1*a*, which is typically white if substrate 3 is not colored. FIG. 1*b* also indicates the typical tangible structure of a paper substrate printed by intaglio, with the printing ink extracted from the engraved areas standing out on one side. The pressing of the substrate into the engraved areas of the plate by the elastic pressure cylinder causes printed areas 1*b* to be pressed in a little on the accordingly opposite side of the substrate.

Figure 2A:
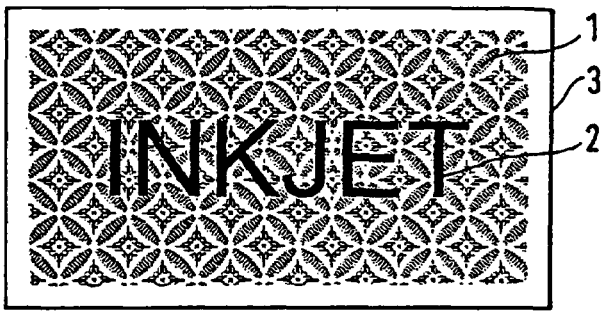
FIG. 2*a* shows the substrate from FIG. 1*a* with a second, individualizing printed image.
Figure 2B:
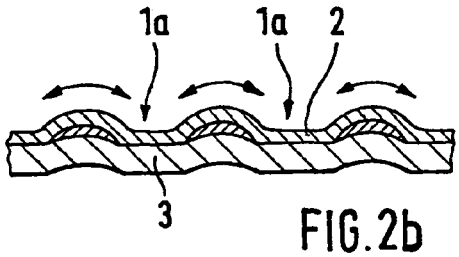
FIG. 2*b* shows the same detail of the substrate as FIG. 1*b* with the additional individualizing print at the time when the individualizing printed image is applied.

The security document with first printed image 1 identical for a group of documents as described with respect to FIGS. 1*a*, 1*b* is then individualized by a second printed image being printed over the first printed image by the ink jet printing method, as shown in a top view in FIG. 2*a* and in cross section in FIG. 2*b*. The individualizing print reads "INKJET" in this embodiment. It can be printed with black or colored printing ink. Instead of the print "INKJET," individualizing print 2 might for example also comprise personal individual data or a multicolor or black-and-white photograph.

FIG. 2*b* shows the layer structure of the document from FIG. 2*a* at the time when substrate 3 is printed with individualizing printed image 2. First and second areas 1*a*, 1*b* of first printed image 1 are first overprinted completely using a Canon BJC7100 ink jet printer with a commercial black printing ink cartridge. Due to the repellent effect of the intaglio printing ink on the printing ink of individualizing printed image 2, the latter printing ink flows laterally off the intaglio printing ink and is deposited in unprinted spaces 1*a*. This process is indicated by double arrows in FIG. 2*b*. The result is a distribution of material as shown in FIG. 3*b*, according to which the printing ink of individualizing printed image 2 only colors areas 1*a* of substrate 3 that remained unprinted when first image 1 was printed by intaglio.

Figure 3A:
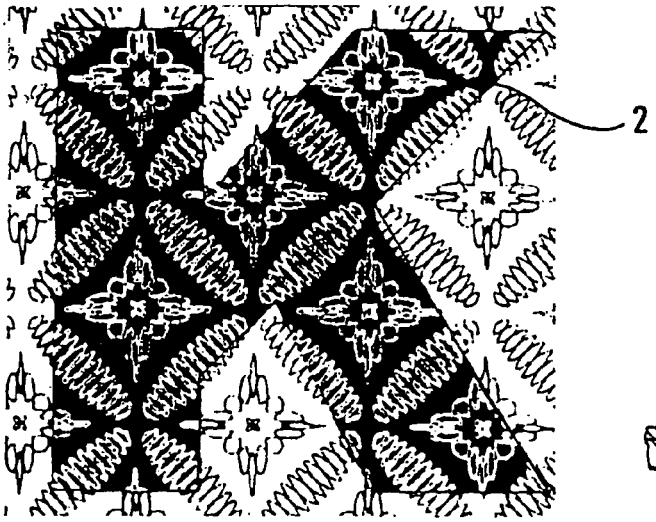
FIG. 3*a* shows an enlarged representation of the first and second printed images printed one over the other.
Figure 3B:
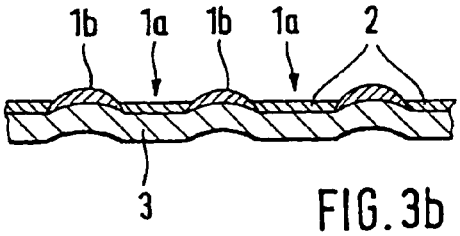
FIG. 3*b* shows the same detail as FIG. 2*b* shortly after the second, individualizing printed image is printed.

FIG. 3*a* shows an enlarged top view of this effect with reference to the letter "K" of individualizing printed image 2. Printed image 1 applied by intaglio printing forms a regular background pattern here, for example in red color on a white background. In the area of the letter "K" of individualizing printed image 2 the unprinted intermediate areas of background pattern 1 are filled with black printing ink, and the red color of the background pattern which is lighter by comparison remains recognizable visually and without aids in the individualizing printed image. Such a combination of two superimposed printed images, one of which is also tactile, guarantees high protection from forgery since it is not reproducible by simple conventional printing methods or color copiers. It can be checked without elaborate aids even by non-experts, and unauthorized subsequent changes and tamperings in individual printed image 2, for example by erasure or covering, are easily recognizable due to the change in printed image 1 that they almost necessarily cause.

The invention claimed is:

1. A method for individualizing security documents comprising the steps of:

intaglio printing a document to create a first, high security quality embossed ink printed image in the document comprising mutually contrasting light and dark areas, and printing at least part of the first printed image with a second printed image, wherein the material selected for printing the second printed image is a printing ink that is flowable at least at the time of printing and repelled either by the dark areas or by the light areas of the first printed image and is deposited in the accordingly other areas so that it remains only in said other areas.

2. A method according to claim 1, wherein the light areas of the first printed image are unprinted areas of the document.

3. A method according to claim 1, wherein the first printed image is printed on a security paper.

4. A method according to claim 1, wherein the second printed image is produced by the ink jet printing method.

5. A method according to claim 1, wherein the second printed image is produced by the Indigo printing process.

6. A method according to claim 1, wherein the second printed image comprises a photograph of a person.

7. A method according to claim 1, wherein the second printed image comprises personal data in plaintext.

8. A method according to claim 1, wherein the second printed image comprises data in the form of a bar code.

9. A method according to claim 1, wherein the documents are passports.

10. A method according to claim 1, wherein the documents are visa stickers.

11. A method according to claim 1, wherein the documents are documents selected from the following group: documents accompanying goods, customs documents, authenticity certificates as stickers or tags or labels, vouchers, admission tickets, checks, shares, deeds.

12. A method according to claim 1, wherein the first printed image is identical for a group of documents and the second printed image is different for subgroups of the group of documents.

13. A method according to claim 1, wherein the first printed image is identical for a group of documents and the second printed image is different for each document of the group of documents.

* * * * *